US008490744B2

(12) United States Patent
Nakamura et al.

(10) Patent No.: US 8,490,744 B2
(45) Date of Patent: Jul. 23, 2013

(54) COMBUSTOR AND GAS TURBINE HAVING THE SAME

(75) Inventors: Sosuke Nakamura, Hyogo (JP); Taiki Kinoshita, Hyogo (JP); Masaki Ono, Hyogo (JP); Keisuke Matsuyama, Hyogo (JP); Kenta Taniguchi, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/121,874

(22) PCT Filed: Oct. 15, 2009

(86) PCT No.: PCT/JP2009/067839
§ 371 (c)(1),
(2), (4) Date: May 5, 2011

(87) PCT Pub. No.: WO2010/097982
PCT Pub. Date: Sep. 2, 2010

(65) Prior Publication Data

US 2011/0220433 A1 Sep. 15, 2011

(30) Foreign Application Priority Data

Feb. 27, 2009 (JP) ..... 2009-047358

(51) Int. Cl.
*F02K 1/00* (2006.01)

(52) U.S. Cl.
USPC ..... 181/213; 181/212; 244/1 N

(58) Field of Classification Search
USPC ..... 181/213, 212; 244/1 N
See application file for complete search history.

(56) References Cited

U.S. PATENT DOCUMENTS

| | | | | |
|---|---|---|---|---|
| 4,944,362 | A * | 7/1990 | Motsinger et al. | 181/213 |
| 6,615,576 | B2 * | 9/2003 | Sheoran et al. | 60/39.5 |
| 6,640,544 | B2 * | 11/2003 | Suenaga et al. | 60/725 |
| 6,973,790 | B2 * | 12/2005 | Suenaga et al. | 60/725 |
| 2002/0066272 | A1 | 6/2002 | Suenaga et al. | |
| 2005/0223707 | A1 * | 10/2005 | Ikeda et al. | 60/725 |
| 2007/0034446 | A1 * | 2/2007 | Proscia et al. | 181/290 |
| 2010/0012423 | A1 * | 1/2010 | Mercat | 181/292 |
| 2010/0224159 | A1 * | 9/2010 | Prior | 123/184.53 |
| 2011/0284318 | A1 * | 11/2011 | Arilla et al. | 181/213 |

FOREIGN PATENT DOCUMENTS

| | | | |
|---|---|---|---|
| CN | 1705815 | A | 12/2005 |
| JP | 2002-174427 | A | 6/2002 |
| JP | 2004-183943 | A | 7/2004 |
| JP | 2006-022966 | A | 1/2006 |
| JP | 2006-266671 | A | 10/2006 |

OTHER PUBLICATIONS

International Search Report of PCT/JP2009/067839, date of mailing Jan. 12, 2010.
Written Opinion of the International Searching Authority, issued in corresponding International Application No. PCT/JP2009/067839.
Chinese Office Action dated Aug. 31, 2012, issued in corresponding Chinese Patent Application No. 200980137920.5, (14 pages). With English Translation.
Notice of Allowance dated May 14, 2013 issued in corresponding Japanese Patent Application No. 2011-501455. English Translation.

* cited by examiner

*Primary Examiner* — Forrest M Phillips
(74) *Attorney, Agent, or Firm* — Westerman, Hattori, Daniels & Adrian, LLP

(57) ABSTRACT

An object is to provide a combustor that requires a small mounting space for an acoustic damper, that can achieve size reduction, and that can improve the ease of maintenance. A combustor (5) of the present invention includes a combustion cylinder (19) that defines a combustion area (23) therein and an acoustic damper (31) that has a damper cover having an acoustic-damper resonance space communicating with the combustion area (23). The damper cover is provided along the combustion cylinder (19) so as to extend in a direction intersecting an axial direction (L) of the combustion cylinder (19).

7 Claims, 7 Drawing Sheets

COMBUSTOR AND GAS TURBINE HAVING THE SAME

TECHNICAL FIELD

The present invention relates to a combustor and a gas turbine having the same.

BACKGROUND ART

A gas turbine includes a compressor, a combustor, and a turbine. The compressor takes in air, compresses the air to increase its pressure, and directs the high-pressure air to the combustor.

In the combustor, fuel is sprayed into the high-pressure air to combust the fuel. High-temperature combustion gas generated by the combustion of the fuel is directed to the turbine, and this high-temperature combustion gas drives the turbine.

Because the turbine and the compressor rotate about the same rotation shaft, this driving of the turbine drives the compressor, causing the compressor to take in and compress air, as described above.

The gas turbine operating as above may suffer from combustion oscillations during combustion of the fuel, and such combustion oscillations have been a cause of noise and vibration during operation of the gas turbine.

In particular, recent gas turbines have reduced the NOx (nitrogen oxide) level in the exhaust gas from the standpoint of the impact on the environment during operation and often employ lean combustion of fuel to reduce the NOx level. However, because lean combustion tends to cause unstable combustion, combustion oscillations are likely to occur. In order to reduce the noise and vibration caused by the combustion oscillations, combustors have been provided with an acoustic liner for absorbing relatively high-frequency noise, which is made of, for example, a porous plate and a cover that covers the outside thereof; or an acoustic damper having a large resonance space for absorbing relatively low-frequency noise.

Because the volume of the resonance space in the acoustic liner for relatively high-frequency noise is small, there are few space limitations in the casing during installation.

In contrast, because the volume of the resonance space in the acoustic damper for relatively low-frequency noise is large, there are space limitations in the casing during installation. Conventionally, as shown in, for example, PTL 1, in a combustor having a bypass flow path for allowing air in the casing to be introduced into the combustion gas, an acoustic damper that utilizes the circumference of the bypass flow path is provided.

Furthermore, as shown in, for example, PTL 2, a combustor having no bypass flow path has been proposed, in which the acoustic damper is connected to the acoustic liner fitted around the combustor and in which an acoustic portion forming the resonance space of the acoustic damper is provided so as to extend in the axial direction or radial direction of the combustor.

CITATION LIST

Patent Literature

{PTL 1} Japanese Unexamined Patent Application, Publication No. 2006-22966

{PTL 2} Japanese Unexamined Patent Application, Publication No. 2006-266671

SUMMARY OF INVENTION

Technical Problem

Meanwhile, the disclosure in PTL 1 requires a large space outside the combustor for providing the bypass flow path and the acoustic damper. Furthermore, the disclosure in PTL 2 requires a large space outside the combustor for providing the bypass flow path and the acoustic damper, because even an acoustic damper extending in the axial direction, not to mention an acoustic damper extending in the radial direction, is bent in the radial direction to ensure the volume (overall length) of the resonating space.

Thus, because a large casing space is required, the size of a housing is increased, which may make, for example, ground transportation of the gas turbine impossible. Thus, the manufacturing costs, including the transportation costs, increase.

The combustors are subjected to periodic maintenance. However, the combustors cannot be extracted unless the bypass flow path is removed in PTL 1 and the acoustic damper is removed in PTL 2. Accordingly, the maintenance involves a great deal of work.

The present invention has been made in view of the above-described problems, and an object thereof is to provide a combustor that requires a small mounting space for an acoustic damper, that can achieve size reduction, and that can improve the ease of maintenance, and to provide a gas turbine using such a combustor.

Solution to Problem

In order to achieve the above-described object, the present invention provides the following solutions.

A first aspect of the present invention is a combustor including a cylindrical body that defines a combustion area therein, and an acoustic damper that includes an acoustic portion having an acoustic-damper resonance space communicating with the combustion area. The acoustic portion is provided along the cylindrical body so as to extend in a direction intersecting an axial direction of the cylindrical body.

According to this aspect, because the acoustic portion having the acoustic-damper resonance space is provided along the cylindrical body so as to extend in the direction intersecting the axial direction of the cylindrical body, or the circumferential direction, the acoustic portion is disposed widely in the circumferential direction, without concentrating in a particular area of the cylindrical body in the circumferential direction. As a result, the acoustic portion is prevented from protruding toward the outer circumference of the cylindrical body, and the space needed outside the combustor can be reduced.

Thus, because the casing can be made small, the housing constituting the casing can be made small. Because this enables, for example, the gas turbine to be adequately transported on the ground, it is possible to reduce the manufacturing costs, including the transportation costs.

Furthermore, if the protrusion of the acoustic portion toward the outer circumference of the cylindrical body is reduced, the combustor can be easily extracted together with the acoustic damper. Thus, it is possible to improve the ease of maintenance of the combustor.

The above-described aspect may further include an acoustic liner formed by a porous plate that constitutes the cylindrical body and has a plurality of through-holes penetrating in a thickness direction and a cover member that is provided around and at a certain distance from the porous plate so as to cover the porous plate, the acoustic liner having an acoustic-liner resonance space.

By doing so, it is possible to attenuate oscillations in a frequency region that can be attenuated by the acoustic liner and oscillations in a frequency region that can be attenuated by the acoustic damper. Accordingly, it is possible to attenuate combustion oscillations in a wide frequency region.

In the above configuration, it is preferable that at least part of the acoustic portion be provided on the outer circumferential side of the acoustic liner.

In this configuration, because the acoustic liner and the acoustic damper are provided so as to be concentrated in a certain area of the cylindrical body in the axial direction, the other portions of the cylindrical body in the axial direction can be efficiently used.

In the above aspect, the acoustic-damper resonance space may be formed so as to make at least one turn.

This enables a sufficient volume (overall length) of the acoustic-damper resonance space to be ensured, even when, for example, the volume (overall length) of the acoustic-damper resonance space cannot be ensured by using the entire circumferential length of the cylindrical body, or, another member needs to be provided at a position of the cylindrical body in the axial direction where the acoustic damper is provided.

In the above aspect, at least one fluid resisting member may be provided in the acoustic-damper resonance space.

By doing so, it is possible to attenuate oscillations and noise caused by the combustion oscillations also with the fluid resisting member.

Furthermore, the frequency region of the oscillations to be attenuated can be adjusted not only by changing the volume (overall length) of the acoustic-damper resonance space, but also by changing the resistance exerted by the fluid resisting member. Accordingly, the oscillation attenuating performance of the acoustic damper can be more assuredly improved.

In the above aspect, a plurality of the acoustic dampers may be provided.

In this configuration, because the oscillations can be attenuated by a plurality of the acoustic dampers, the oscillations can be more assuredly attenuated.

In such a case, the volumes (overall lengths) of the acoustic-damper resonance spaces of the plurality of acoustic dampers may be different from each other. By doing so, it is possible to attenuate oscillations in different frequency regions with the respective acoustic dampers.

Accordingly, the oscillation attenuating performance of the acoustic dampers can be more assuredly improved.

A second aspect of the present invention is a gas turbine including an air compressor, the combustor according to the first aspect, and a turbine.

Because the gas turbine according to this aspect includes the combustor capable of reducing the size of the housing, reducing the manufacturing costs, and improving the ease of maintenance, it is possible to reduce the noise caused by the combustion during operation of the gas turbine and to improve the ease of maintenance. Furthermore, low-cost manufacturing thereof is possible.

Advantageous Effects of Invention

According to the present invention, because the acoustic portion having the acoustic-damper resonance space is provided along the cylindrical body so as to extend in a direction intersecting the axial direction of the cylindrical body, or the circumferential direction, the space needed outside the combustor can be reduced.

Thus, because the casing can be made small, the housing constituting the casing can be made small. Because this enables, for example, the gas turbine to be adequately transported on the ground, it is possible to reduce the manufacturing costs, including the transportation costs. Furthermore, if the protrusion of the acoustic portion toward the outer circumference of the cylindrical body is reduced, the combustor can be easily extracted together with the acoustic damper. Thus, it is possible to improve the ease of maintenance of the combustor.

DESCRIPTION OF EMBODIMENTS

Embodiments of a gas turbine of the present invention will be described below, on the basis of the drawings.

First Embodiment

Referring to FIGS. 1 to 4, a gas turbine 1 according to a first embodiment of the present invention will be described.

Figure 1:
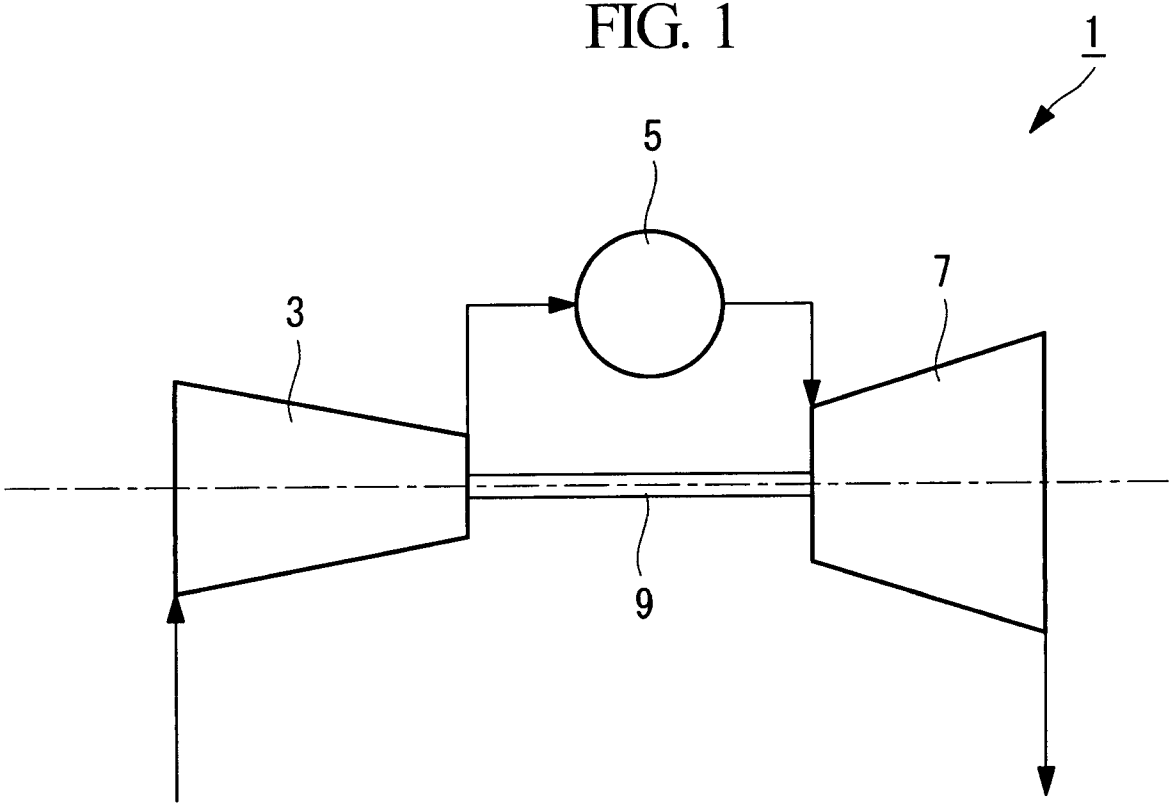
FIG. 1 is a schematic view showing the overall configuration of a gas turbine according to a first embodiment of the present invention.
Figure 2:
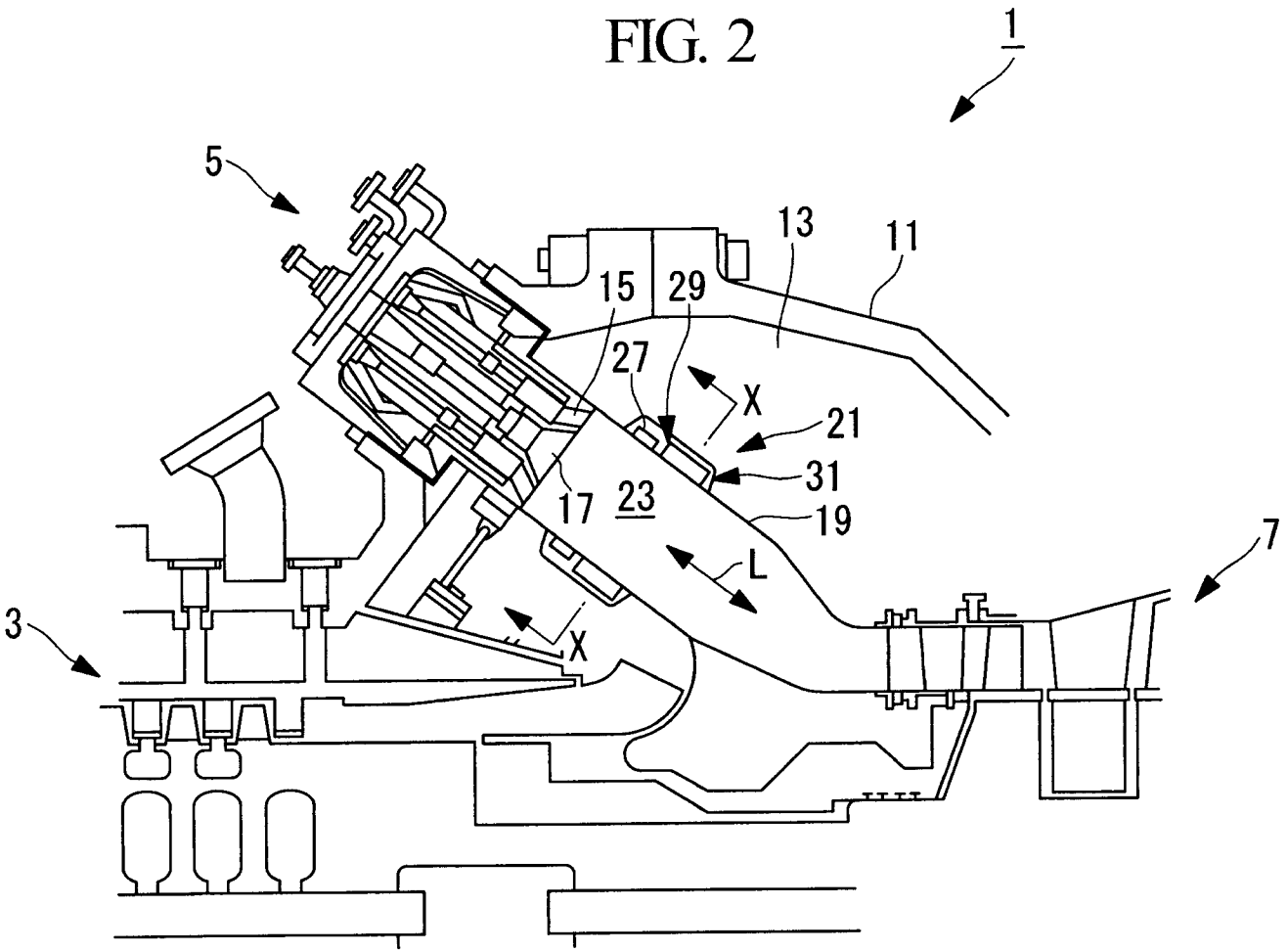
FIG. 2 is a schematic view for describing, in outline, the configuration of a combustor in FIG. 1.

FIG. 1 is a schematic view for describing the configuration of the gas turbine 1 according to this embodiment. FIG. 2 is a schematic view for describing, in outline, the configuration of combustors 5 in FIG. 1.

As shown in FIGS. 1 and 2, the gas turbine 1 includes a compressor 3, the combustors 5, a turbine unit (turbine) 7, a rotation shaft 9, and a housing 11 that accommodates these components in place.

The compressor 3 takes in and compresses the atmosphere, which is the outside air, and supplies the compressed air to the combustors 5.

Note that the configuration of the compressor 3 may be any known one and is not specifically limited.

As shown in FIG. 1, the combustors 5 generate combustion gas (high-temperature gas) by mixing the air compressed by the compressor 3 and externally supplied fuel and combusting the mixed gaseous mixture. The plurality of (for example, 16) combustors 5 are disposed in the circumferential direction and are mounted to the housing 11 so as to penetrate therethrough and reach a casing 13.

As shown in FIG. 2, each combustor 5 mainly includes air supply ports 15, a fuel nozzle 17, a combustion cylinder 19 (cylindrical body), and an attenuating device 21.

As shown in FIG. 2, the air supply ports 15 are disposed around the fuel nozzle 17 in a ring-like manner and introduce the air compressed by the compressor 3 into the combustion cylinder 19. The air supply ports 15 give a flow-velocity component in a turning direction to the air flowing into the combustion cylinder 19 and produce a circulating flow in the combustion cylinder 19.

Note that the shape of the air supply ports 15 may be any known one and is not specifically limited.

As shown in FIG. 2, the fuel nozzle 17 sprays the externally supplied fuel toward the inside of the combustion cylinder 19. The fuel sprayed from the fuel nozzle 17 is stirred by an air flow or the like created by the air supply ports 15, forming a gaseous mixture composed of fuel and air.

Note that the shape of the fuel nozzle 17 may be any known one and is not specifically limited.

As shown in FIG. 2, the combustion cylinder 19 is formed in a cylindrical shape and forms a flow path extending from the air supply ports 15 and the fuel nozzle 17 to an inlet portion of the turbine unit 7. In other words, the combustion cylinder 19 forms a combustion area 23 therein, through which the gaseous mixture composed of fuel and air, as well as the combustion gas generated by the combustion of the gaseous mixture, flow.

The combustion cylinder 19 is formed of a heat-resistant metal, such as a nickel-base alloy.

A plurality of cooling paths 25 (see FIG. 4) extending in an axial direction L and disposed with spaces therebetween in the circumferential direction C are formed in a wall of the combustion cylinder 19.

The cooling paths 25 are connected to, for example, a boiler (not shown) at one end so that steam, serving as coolant, flows therethrough. The cooling paths 25 are connected to a steam-discharging flow path 27 at the other end. The steam having passed through the cooling paths 25 is discharged outside the system through the steam-discharging flow path 27 or is returned to the boiler.

Although this embodiment shows a case where steam is used as the coolant for cooling the combustion cylinder 19, air may also be used depending on the design conditions. In such a case, the steam-discharging flow path 27 is unnecessary. The structure of the air cooling structure may be any known one and is not specifically limited.

Figure 3:
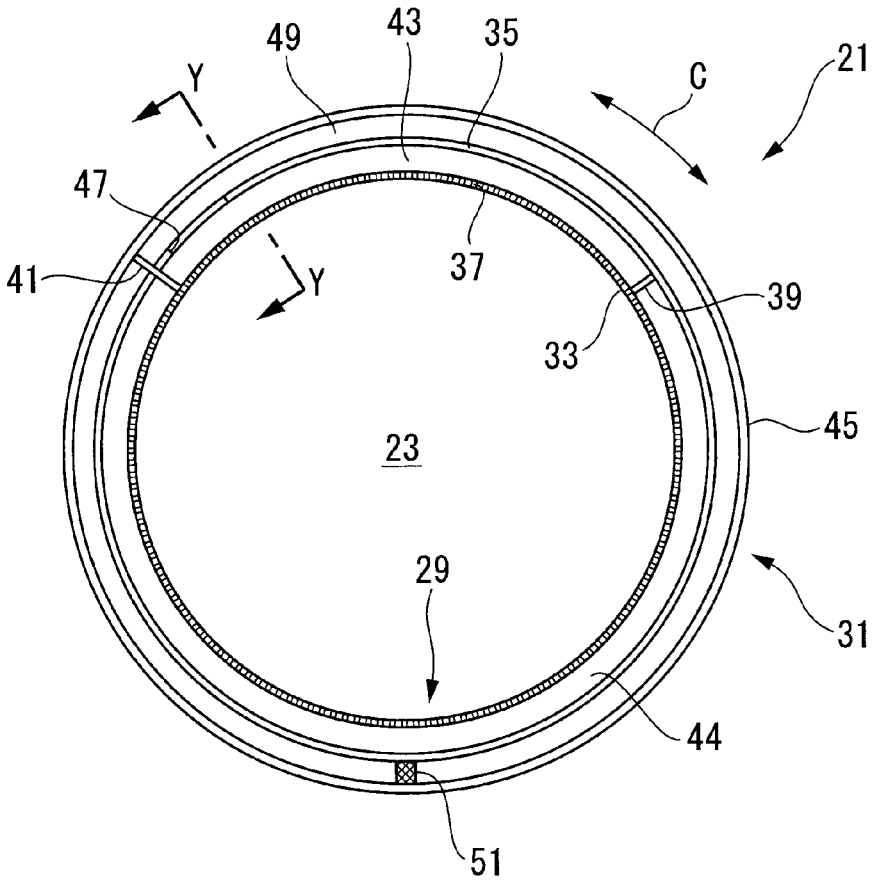
FIG. 3 is a cross-sectional view taken along line X-X in FIG. 2.
Figure 4:
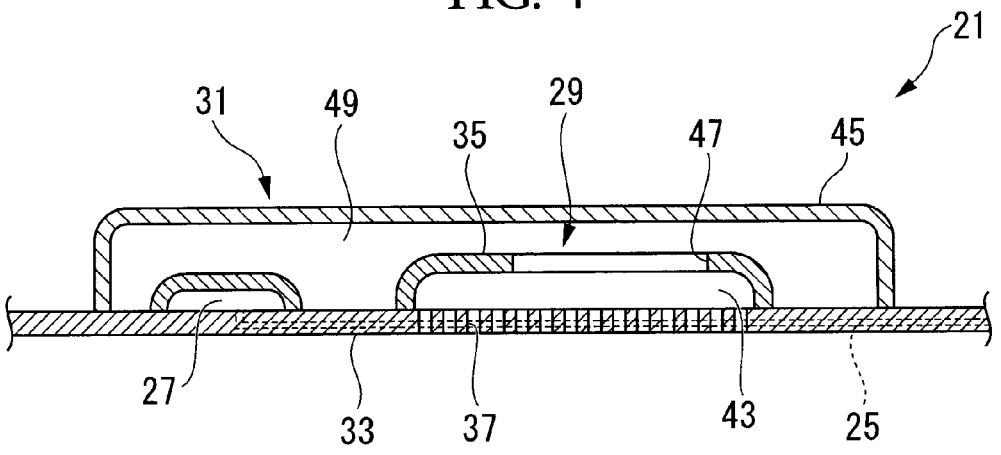
FIG. 4 is a cross-sectional view taken along line Y-Y in FIG. 3.

FIG. 3 is a cross-sectional view taken along line X-X in FIG. 2. FIG. 4 is a cross-sectional view taken along line Y-Y in FIG. 3. The attenuating device 21 includes an acoustic liner 29 and an acoustic damper 31. The acoustic liner 29 includes a liner cover (cover member) 35 and a cylindrical plate (porous plate) 33 constituting part of the combustion cylinder 19.

The plate 33 has many (a plurality of) cylindrical through-holes 37 provided over substantially the entire circumference thereof.

Rows of the through-holes 37 are provided in the axial direction L and the circumferential direction C, so as to be spaced apart from one another. Furthermore, all the through-holes 37 may have the same shape, or the through-holes 37 in a first acoustic-damper resonance space 43 may have a shape different from those in an acoustic-liner resonance space 44 (described below); it is not specifically limited.

The liner cover 35 is a ring-like member having a U-shaped cross-section with the inner circumferential side being open. The liner cover 35 is provided on the outer circumferential side of the plate 33 so as to surround the entire circumference thereof.

The length of the open portion of the liner cover 35 in the axial direction L is larger than the area where the through-holes 37 are provided.

The liner cover 35 is joined to the plate 33 at the open ends of the U-shaped cross-section by, for example, brazing. Note that the liner cover 35 may be mounted by welding.

By doing so, a space is formed between the liner cover 35 and the outer surface of the plate 33. This space is divided by a first partition 39 and a second partition 41 in the circumferential direction C.

In FIG. 3, a space on the upper part, which extends over about one-third of the entire circumference and is surrounded by the plate 33, the liner cover 35, the first partition 39, and the second partition 42, constitutes the first acoustic-damper resonance space 43, and an area on the lower part, which extends over about two-thirds, constitutes the acoustic-liner resonance space 44.

The acoustic damper 31 includes a damper cover (acoustic portion) 45 and an opening 47 provided in the liner cover 35. The damper cover 45 is a ring-like member having a U-shaped cross-section with the inner circumferential side being open.

The damper cover 45 is provided on the outer circumferential side of the liner cover 35 so as to surround substantially the entire circumference thereof.

As shown in FIG. 4, the length of the open portion of the damper cover 45 in the axial direction L is larger than the area where the steam-discharging flow path 27 and the liner cover 35 are formed.

Note that, as described above, when air is used as the coolant for the combustion cylinder 19, the steam-discharging flow path 27 is unnecessary. Thus, the damper cover 45 may be formed to have a size sufficient to surround the liner cover 35.

The open ends of the damper cover 45 having a U-shaped cross-section are joined to the plate 33 (combustion cylinder 19) by, for example, brazing. Note that the damper cover 45 may be mounted by welding.

By doing so, a space is formed between the damper cover 45 and the outer surface of the plate 33. This space is divided by the second partition 41 in the circumferential direction C.

The space surrounded by the plate 33, the damper cover 45, the outer surface of the liner cover 35, the outer surface of the steam-discharging flow path 27, and the second partition 41 is formed as a second acoustic-damper resonance space 49.

Because the second acoustic-damper resonance space 49 is formed over the entire circumference and has a large cross-sectional area, it has a much larger volume (overall length) than the acoustic-liner resonance space 44.

Although the second partition 41 is a common member that divides the first acoustic-damper resonance space 43 and the acoustic-liner resonance space 44 in this embodiment, the second partition 41 may be provided as a separate member so as to ensure the necessary volumes (overall lengths) for the respective resonance spaces, if necessary.

The opening 47 is provided in the liner cover 35, near the second partition 41. The opening 47 has a substantially rectangular shape elongated in the axial direction L and penetrates through the liner cover 35.

The second acoustic-damper resonance space 49 communicates with the first acoustic-damper resonance space 43 via the opening 47. The first acoustic-damper resonance space 43 communicates with the combustion area 23 via the through-holes 37, which consequently allows the second acoustic-damper resonance space 49 to communicate with the combustion area 23, to serve as an integral acoustic damper 31.

Because the damper cover 45 is provided along the combustion cylinder 19 so as to extend in the circumferential direction C in this manner, the damper cover 45 is disposed widely in the circumferential direction C, without concentrating in a particular area of the combustion cylinder 19 in the circumferential direction C. As a result, the damper cover 45 is prevented from protruding toward the outer circumference of the combustion cylinder 19, and the space needed outside the combustors 5 can be reduced. Thus, because the casing 13 can be made small, the housing 11 constituting the casing 13 can be made small. Because this enables the gas turbine 1 to have such a size, for example, that it can be transported on the ground, it is possible to reduce the manufacturing costs, including the transportation costs.

Furthermore, by forming the liner cover 35 constituting part of the acoustic liner 29 integrally with a component of the acoustic damper 31 so as to serve the function thereof, the material can be reduced compared with the case where the acoustic damper 31 is formed separately from the combustion cylinder 19. Thus, the manufacturing costs of the acoustic damper 31 can be reduced.

Furthermore, if the protrusion of the damper cover 45 toward the outer circumference of the combustion cylinder 19 is reduced, the combustors 5 can be extracted together with the acoustic damper 31, by, for example, slightly enlarging the mounting portion of the combustors 5, or even without changing anything. Because this facilitates extraction of the combustors 5, the ease of maintenance of the combustors 5 can be improved.

A porous metal member (fluid resisting member) 51 is provided in the second acoustic-damper resonance space 49. This porous metal member 51 is composed of a porous metal, i.e., a metal having multiple small holes. The porous metal member 51 is provided in the second acoustic-damper resonance space 49, at part of the damper cover 45, such that the porous metal member 51 has substantially the same shape as the internal space of the damper cover 45.

Note that the porous metal member 51 is used depending on necessity and, thus, it may be omitted.

As shown in FIG. 1, the turbine unit 7 generates a rotational driving force by receiving a supply of high-temperature gas produced by the combustors 5 and transmits the generated rotational driving force to the rotation shaft 9.

As shown in FIG. 1, the rotation shaft 9 is a cylindrical member supported so as to be rotatable about the rotation axis and transmits the rotational driving force generated by the turbine unit 7 to the compressor 3.

Note that the configurations of the turbine unit 7 and rotation shaft 9 may be any known ones and are not specifically limited.

Next, the effects and advantages of the gas turbine 1 having the above-described configuration will be described.

As shown in FIG. 1, the gas turbine 1 takes in the atmosphere (air) as the compressor 3 is rotationally driven. The intake atmosphere is compressed by the compressor 3 and is directed to the combustors 5.

The compressed air flowing into the combustors 5 is mixed with externally supplied fuel in the combustors 5. The gaseous mixture composed of fuel and air is combusted in the combustors 5, and the combustion heat produces high-temperature combustion gas.

The combustion gas produced in the combustors 5 is supplied from the combustors 5 to the downstream turbine unit 7. The turbine unit 7 is rotationally driven by high-temperature gas, and the rotational driving force thereof is transmitted to the rotation shaft 9. The rotation shaft 9 transmits the rotational driving force extracted in the turbine unit 7 to the compressor 3 and the like.

When the fuel is combusted in the combustors 5, the combustion may generate combustion oscillations.

In particular, because lean combustion of fuel for reducing the NOx level in the exhaust gas tends to cause unstable combustion, combustion oscillations are likely to occur.

When such combustion oscillations are generated, air oscillations (pressure wave) caused by the combustion oscillations enter the through-holes 37 in the plate 33.

The air in the acoustic-liner resonance space 44 and the air in the through-holes 37 in the acoustic liner 29 constitute a resonator system because the air in the acoustic-liner resonance space 44 serves as a spring. Accordingly, because the air in the through-holes 37 is severely oscillated and resonated with respect to the noise in the frequency region corresponding to the volume (overall length) of the acoustic-liner resonance space 44 and the overall length of the through-holes 37 among the air oscillations and noise caused by the combustion oscillations generated inside the plate 33, the noise at this resonant frequency is absorbed by the friction between the air and the surfaces of the through-holes 37. Thus, the amplitude of the combustion oscillations is attenuated and the noise caused by the combustion oscillations is reduced.

The first acoustic-damper resonance space 43 and the second acoustic-damper resonance space 49 are connected via the opening 47. Therefore, the combustion oscillations generated in the combustion area 23 are transmitted to the second acoustic-damper resonance space 49 via the first acoustic-damper resonance space 43, and these acoustic-damper resonance spaces serve as the integral acoustic damper 31.

The volume (overall length) of this acoustic damper 31 is larger than that of the acoustic-liner resonance space 44. Therefore, the resonance space of the acoustic damper 31 (the first acoustic-damper resonance space 43 and the second acoustic-damper resonance space 49) can attenuate oscillations with a longer wavelength than oscillations attenuated in the acoustic-liner resonance space 44, in other words, oscillations in a lower frequency region than the frequency region of the oscillations that can be attenuated in the acoustic-liner resonance space 44.

Although the acoustic liner 29 and the acoustic damper 31 both attenuate oscillations as described above, the acoustic liner 29 attenuates oscillations in a relatively high frequency region, whereas the acoustic damper 31 attenuates oscillations in a relatively low frequency region.

By providing both the acoustic liner 29 and the acoustic damper 31, it is possible to attenuate oscillations in several frequency regions or oscillations in a wide frequency region.

Accordingly, noise generated during combustion in the combustors 5 can be effectively reduced.

The steam from the boiler is supplied to the cooling paths 25 and is exhausted outside the system from the steam-discharging flow path 27. The steam exchanges heat with the combustion cylinder 19 (plate 33) while flowing through the cooling paths 25, whereby the combustion cylinder 19 is cooled. Thus, the combustion cylinder 19 is cooled during the operation of gas turbine 1.

The combustion gas sometimes enters the through-holes 37 during the operation of the gas turbine 1. The through-holes 37 are heated by the combustion gas that has entered therein, whereby the thermal stress due to the temperature difference with respect to the peripheral portions increases.

Because the plate 33 is cooled by the steam passing through the cooling paths 25, the peripheral portions of the through-holes 37 are sufficiently cooled. Thus, an increase in this thermal stress can be prevented.

Figure 5:
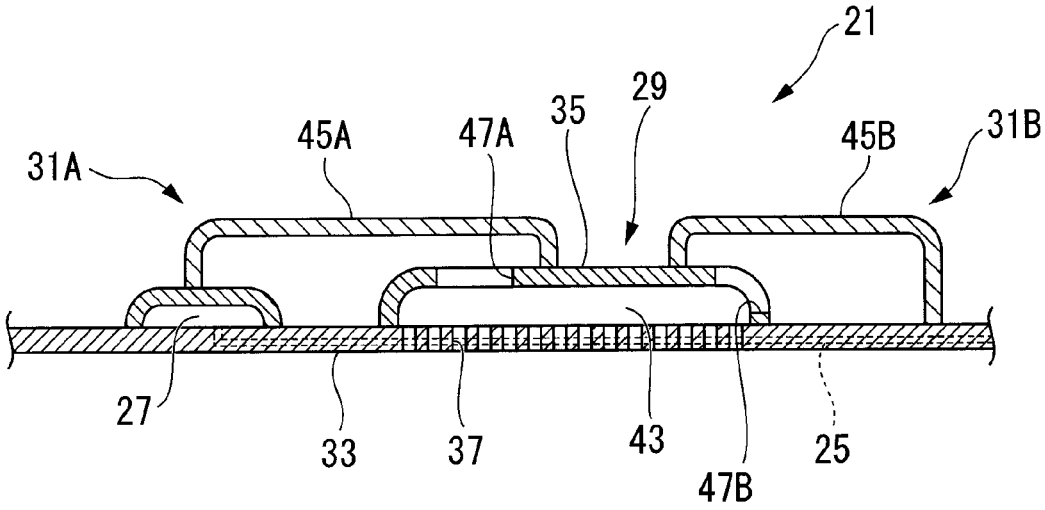
FIG. 5 is a cross-sectional view showing a first modification of an attenuating device according to the first embodiment of the present invention.

FIG. 5 is a cross-sectional view showing the relevant part of the attenuating device 21 according to a first modification of this embodiment. As shown in FIG. 5, the attenuating device 21 according to this modification has two acoustic dampers 31A and 31B spaced apart in the axial direction L. Two damper covers, 45A and 45B, are each joined to the outer surface of the liner cover 35 at one end in the axial direction L. The liner cover 35 has openings 47A and 47B provided at portions covered by the damper covers 45A and 45B, respectively.

The frequency of oscillations that can be absorbed may be changed by changing the length of the damper covers 45A and 45B in the circumferential direction C (the overall length of the resonance space), by changing the mounting position of the porous metal member 51 in the circumferential direction C, or by doing both.

Because the oscillations can be attenuated by the plurality of acoustic dampers 31A and 31B, the oscillations can be more assuredly attenuated. Furthermore, because the two acoustic dampers 31A and 31B attenuate different frequency regions, it is possible to attenuate oscillations in several frequency regions in a relatively low frequency region or oscillations in a wide frequency region.

Accordingly, the oscillation attenuating performance of the acoustic dampers 31A and 31B can be more assuredly improved.

Although the second acoustic-damper resonance space 49 is formed over substantially the entire circumference in this embodiment, it is not limited thereto. The second acoustic-damper resonance space 49 does not need to be formed over the entire circumference but may be formed over a certain portion, as long as it has a volume (overall length) set according to the target frequency region.

Second Embodiment

Next, a second embodiment of the present invention will be described with reference to FIGS. 6 and 7.

Although the basic configuration of the gas turbine according to this embodiment is the same as that according to the first embodiment, the configuration of the attenuating device 21 is different from that according to the first embodiment. Accordingly, in this embodiment, the attenuating device 21, which is different from that according to the first embodiment, will be mainly described, and overlapping descriptions of the other components will be omitted.

Figure 6:
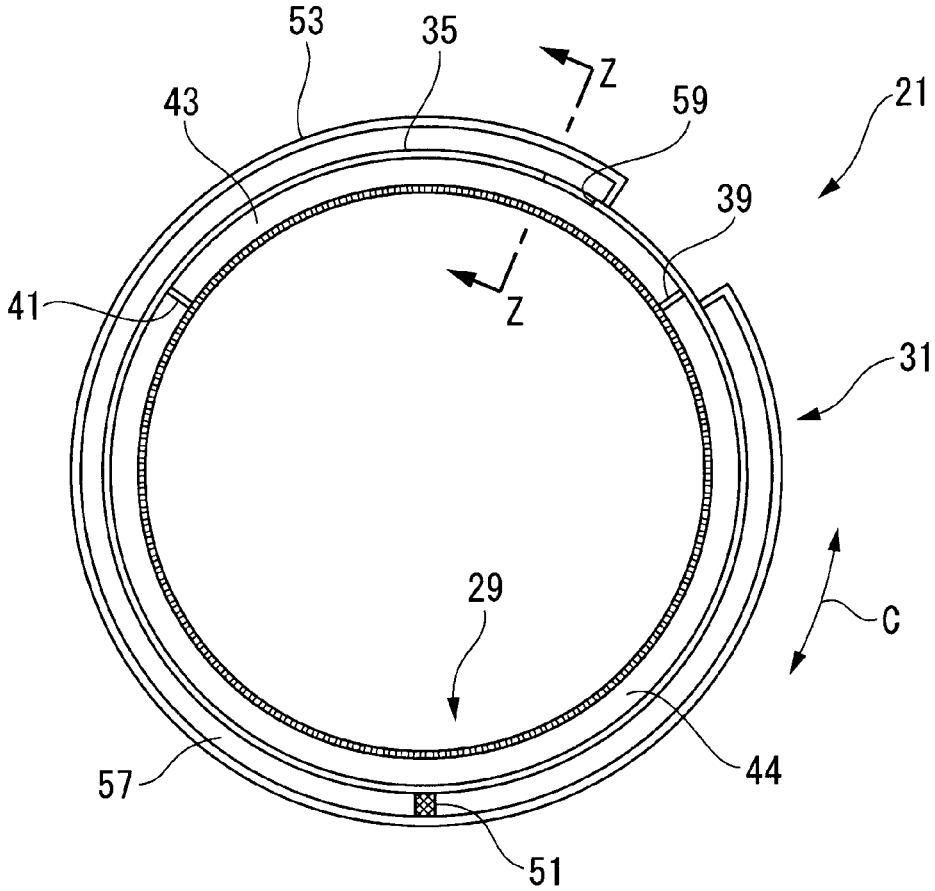
FIG. 6 is a cross-sectional view of an attenuating device according to a second embodiment of the present invention, showing the same portion as in FIG. 4.

FIG. 6 is a cross-sectional view for describing the configuration of the relevant part of the attenuating device 21 in the combustor 5 of the gas turbine 1 according to this embodiment. FIG. 7 is a cross-sectional view taken along line Z-Z in FIG. 6.

Note that the components the same as those in the first embodiment will be denoted by the same reference numerals, and the descriptions thereof will be omitted.

In this embodiment, a damper cover (acoustic portion) 53 is a box that has a substantially rectangular cross-section and is curved so as to constitute part of a ring. As shown in FIG. 6, the damper cover 53 is provided on the outer circumferential side of the liner cover 35 so as to cover the circumference thereof.

Although a portion of the damper cover 53 in the circumferential direction C is removed, at least a portion of this removed portion overlaps the position where the first acoustic-damper resonance space 43 is provided.

A damper groove 55 extending in the circumferential direction C is formed in the inner circumferential surface of the damper cover 53. The damper groove 55 is provided over substantially the overall length of the damper cover 53. The outer circumference of the damper groove 55 is formed of an outwardly protruding wall.

The length of the damper cover 53 in the axial direction L, i.e., the width, is much larger than that of the liner cover 35. As shown in FIG. 7, the length of the damper groove 55 in the axial direction L is smaller than that of the liner cover 35.

The wall of the damper groove 55 in the damper cover 53 is joined to the liner cover 35 by, for example, brazing. Note that the damper cover 53 may be mounted by welding.

Figure 7:
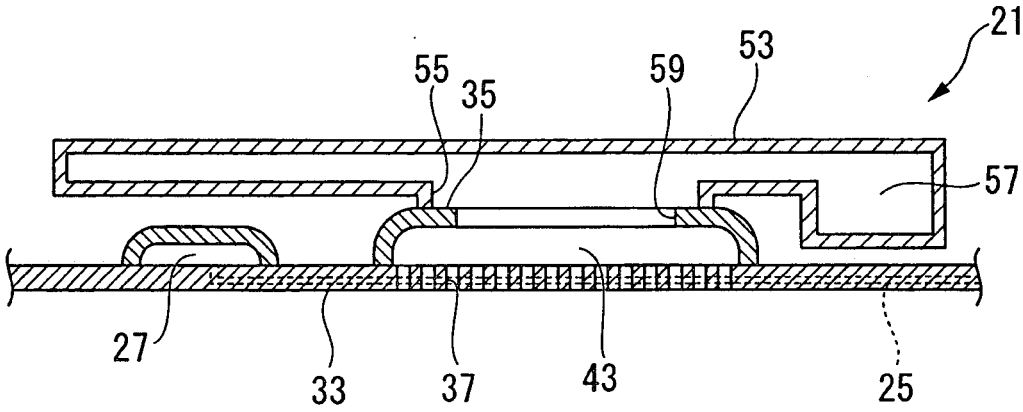
FIG. 7 is a cross-sectional view taken along line Z-Z in FIG. 6.

As shown in FIG. 7, the damper cover 53 is fitted so as to be placed away from the plate 33 (combustion cylinder 19) so as not to touch the plate 33.

By doing so, a space is formed between the damper cover 53 and the outer surface of the liner cover 35. This space is formed as a second acoustic-damper resonance space 57.

Because the second acoustic-damper resonance space 57 is provided over substantially the entire circumference and has a large cross-sectional area, it has a much larger volume (overall length) than the acoustic-liner resonance space 44.

The length of the damper cover 53 in the circumferential direction C is determined so as to ensure the volume (overall length) set according to the target frequency region.

The liner cover 35 has an opening 59 near one circumferential end of the damper cover 53. The opening 59 has a substantially rectangular shape elongated in the axial direction L and penetrates through the liner cover 35.

The second acoustic-damper resonance space 57 communicates with the first acoustic-damper resonance space 43 via the opening 59. The first acoustic-damper resonance space 43 communicates with the combustion area 23 through the through-holes 37, which consequently allows the second acoustic-damper resonance space 57 to communicate with the combustion area 23, to serve as the integral acoustic damper 31.

Because the damper cover 53 is provided along the liner cover 35, i.e., the combustion cylinder 19, so as to extend in the circumferential direction C in this manner, the damper cover 53 is disposed widely in the circumferential direction C, without concentrating in a particular area of the combustion cylinder 19 in the circumferential direction C.

As a result, the damper cover 53 is prevented from protruding toward the outer circumference of the combustion cylinder 19, and the space needed outside the combustors 5 can be reduced. Thus, because the casing 13 can be made small, the housing 11 constituting the casing 13 can be made small. Because this enables the gas turbine 1 to have such a size, for example, that it can be adequately transported on the ground, it is possible to reduce the manufacturing costs, including the transportation costs.

If the protrusion of the damper cover 53 toward the outer circumference of the combustion cylinder 19 is reduced, the combustors 5 can be extracted together with the acoustic damper 31, by, for example, slightly enlarging the mounting portion of the combustors 5, or even without changing anything. Because this facilitates extraction of the combustors 5, the ease of maintenance of the combustors 5 can be improved.

Because the damper cover 53 is fitted so as to be placed away from the plate 33 (combustion cylinder 19) heated by the operation of the combustors 5 in this embodiment, the thermal stress can be reduced compared with the damper cover 45 according to the first embodiment. Because the damper cover 53 is mounted so as not to cover the entire liner cover 35, it is easy to supply purge air to the acoustic-liner resonance space 44 in the liner cover 35.

Third Embodiment

Next, a third embodiment of the present invention will be described with reference to FIGS. 8 and 9. Although the basic configuration of the gas turbine according to this embodiment is the same as that according to the first embodiment, the configuration of the attenuating device 21 is different from that according to the first embodiment. Accordingly, in this embodiment, the attenuating device 21, which is different from that according to the first embodiment, will be mainly described, and overlapping descriptions of the other components will be omitted.

Figure 8:
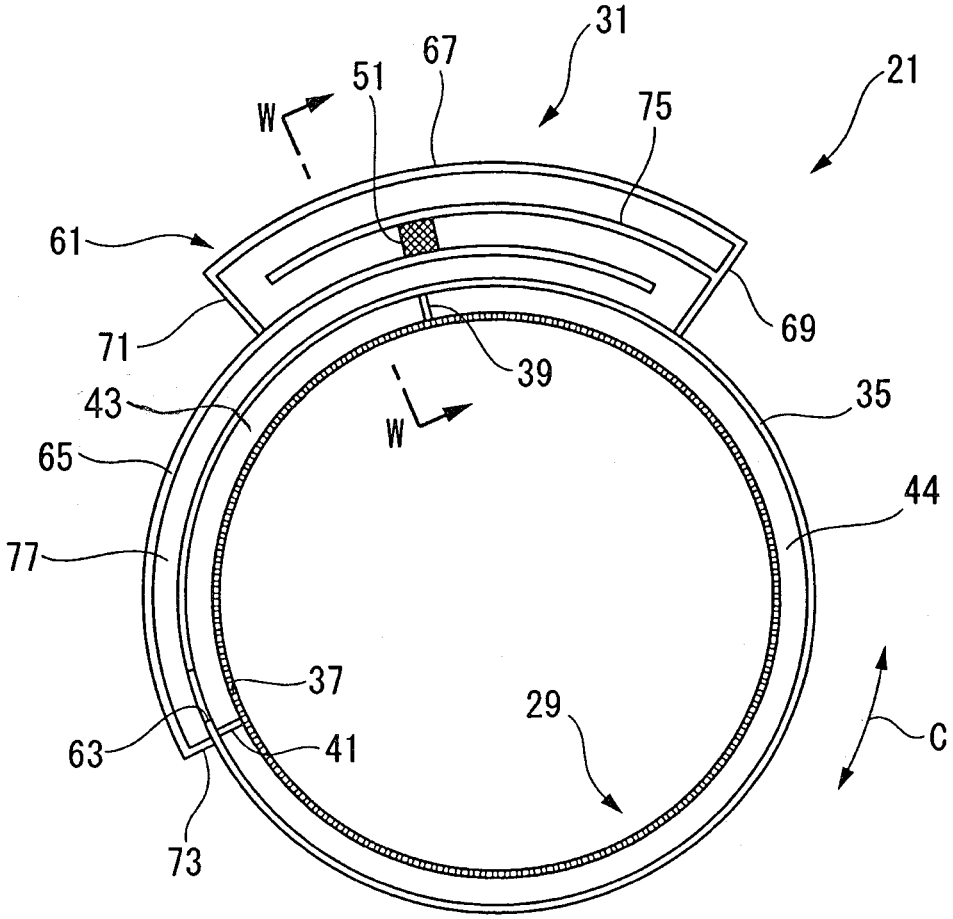
FIG. 8 is a cross-sectional view of an attenuating device according to a third embodiment of the present invention, showing the same portion as in FIG. 4.

FIG. 8 is a cross-sectional view for describing the configuration of the relevant part of the attenuating device 21 in the combustor 5 of the gas turbine 1 according to this embodiment. FIG. 9 is a cross-sectional view taken along line W-W in FIG. 8. Note that the components the same as those in the first embodiment will be denoted by the same reference numerals, and the descriptions thereof will be omitted.

The acoustic damper 31 has a damper cover (acoustic portion) 61 and an opening 63 provided in the liner cover 35.

Figure 9:
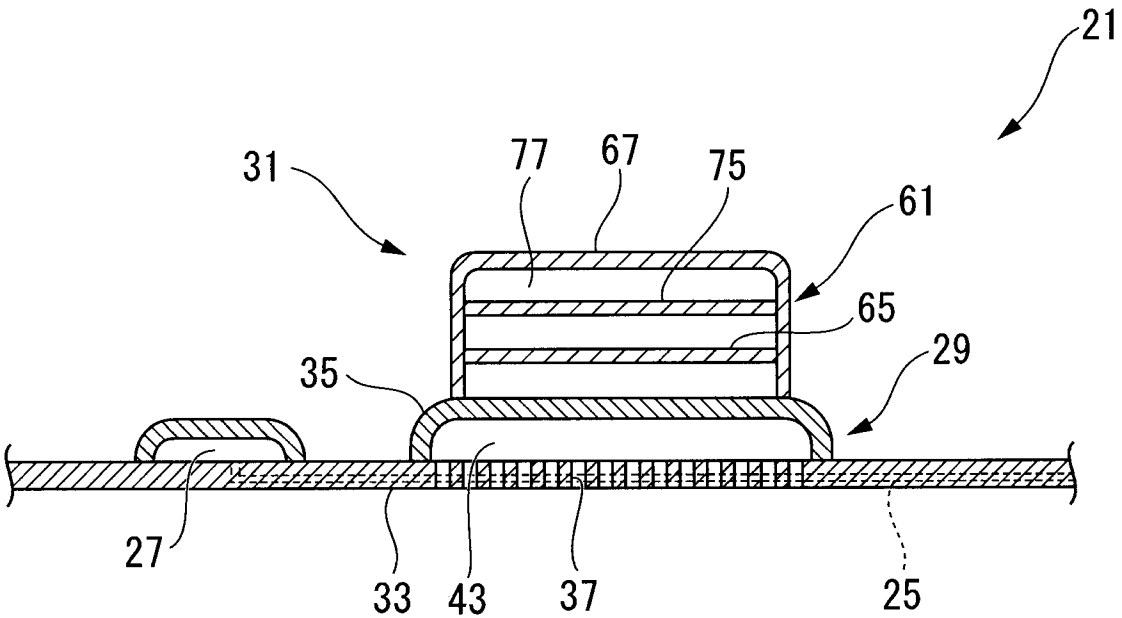
FIG. 9 is a cross-sectional view taken along line W-W in FIG. 8.

As shown in FIG. 9, the damper cover 61 has a rectangular cross-section with the inner circumferential side being open and is curved so as to constitute part of a ring (for example, an area of substantially 160 degrees). As shown in FIG. 8, the damper cover 61 has a small-diameter portion 65 and a large-diameter portion 67, which are different in height and extend in the direction along the curve. Both ends of the large-diameter portion 67 are closed by end plates 69 and 71. The end of the small-diameter portion 65 is closed by an end plate 73.

The end of the small-diameter portion 65 on the large-diameter portion 67 side extends beyond the end plate 71 into the large-diameter portion 67 up to near the end plate 69.

The large-diameter portion 67 has a partition 75 that extends in the circumferential direction and divides the space outside the small-diameter portion 65. An end of the partition 75 extending in the circumferential direction is fixed to the end plate 69, and the other end thereof extends up to near the end plate 71.

As shown in FIG. 9, the length of the open portion in the damper cover 61 in the axial direction L is smaller than that of the liner cover 35.

The open ends of the damper cover 61 having a U-shaped cross-section are joined to the liner cover 35 by, for example, brazing. Note that the damper cover 61 may be mounted by welding.

By doing so, a space is formed between the damper cover 61 and the outer surface of the liner cover 35. This space is formed as a second acoustic-damper resonance space 77.

The second acoustic-damper resonance space 77 includes a first space defined inside the small-diameter portion 65, a second space defined outside the small-diameter portion 65 and inside the partition 75 extending in the circumferential direction, and a third space defined outside the partition 75 extending in the circumferential direction and inside the large-diameter portion 67.

The first space communicates with the second space near the end plate 69. The second space communicates with the third space near the end plate 69. Accordingly, the second acoustic-damper resonance space 77 is formed to have two turns.

Although the second acoustic-damper resonance space 77 is simply provided over an area of substantially 160 degrees in the circumferential direction C, it has two turns. Accordingly, it is possible to ensure a sufficient volume (overall length) for the second acoustic-damper resonance space 77.

Because the second acoustic-damper resonance space 77 has a large cross-sectional area, it has a much larger volume (overall length) than the acoustic-liner resonance space 44.

The opening 63 is provided in the liner cover 35, near the end plate 73. In other words, the opening 63 is located at one end of the second acoustic-damper resonance space 77.

The opening 63 has a substantially rectangular shape elongated in the axial direction L and penetrates through the liner cover 35.

The second acoustic-damper resonance space 77 communicates with the first acoustic-damper resonance space 43 via the opening 63. The first acoustic-damper resonance space 43 communicates with the combustion area 23 via the through-holes 37, which consequently allows the second acoustic-damper resonance space 77 to communicate with the combustion area 23, to serve as the integral acoustic damper 31.

Because the damper cover 61 is provided along the combustion cylinder 19 so as to extend in the circumferential direction C in this manner, the damper cover 61 is disposed relatively widely in the circumferential direction C of the combustion cylinder 19.

As a result, the damper cover 61 is prevented from protruding toward the outer circumference of the combustion cylinder 19, and the space needed outside the combustors 5 can be reduced.

Thus, because the casing 13 can be made small, the housing 11 constituting the casing 13 can be made small. Because this enables the gas turbine 1 to have such a size, for example, that it can be adequately transported on the ground, it is possible to reduce the manufacturing costs, including the transportation costs.

Furthermore, if the protrusion of the damper cover 61 toward the outer circumference of the combustion cylinder 19 is reduced, the combustors 5 can be extracted together with the acoustic damper 31, by, for example, slightly enlarging the mounting portion of the combustors 5, or even without changing anything. Because this facilitates extraction of the combustors 5, the ease of maintenance of the combustors 5 can be improved.

Because the damper cover 61 simply covers less than substantially half of the circumference in the circumferential direction C, it is possible to provide another member in the remaining part, which is more than half of the circumference.

Figure 10:
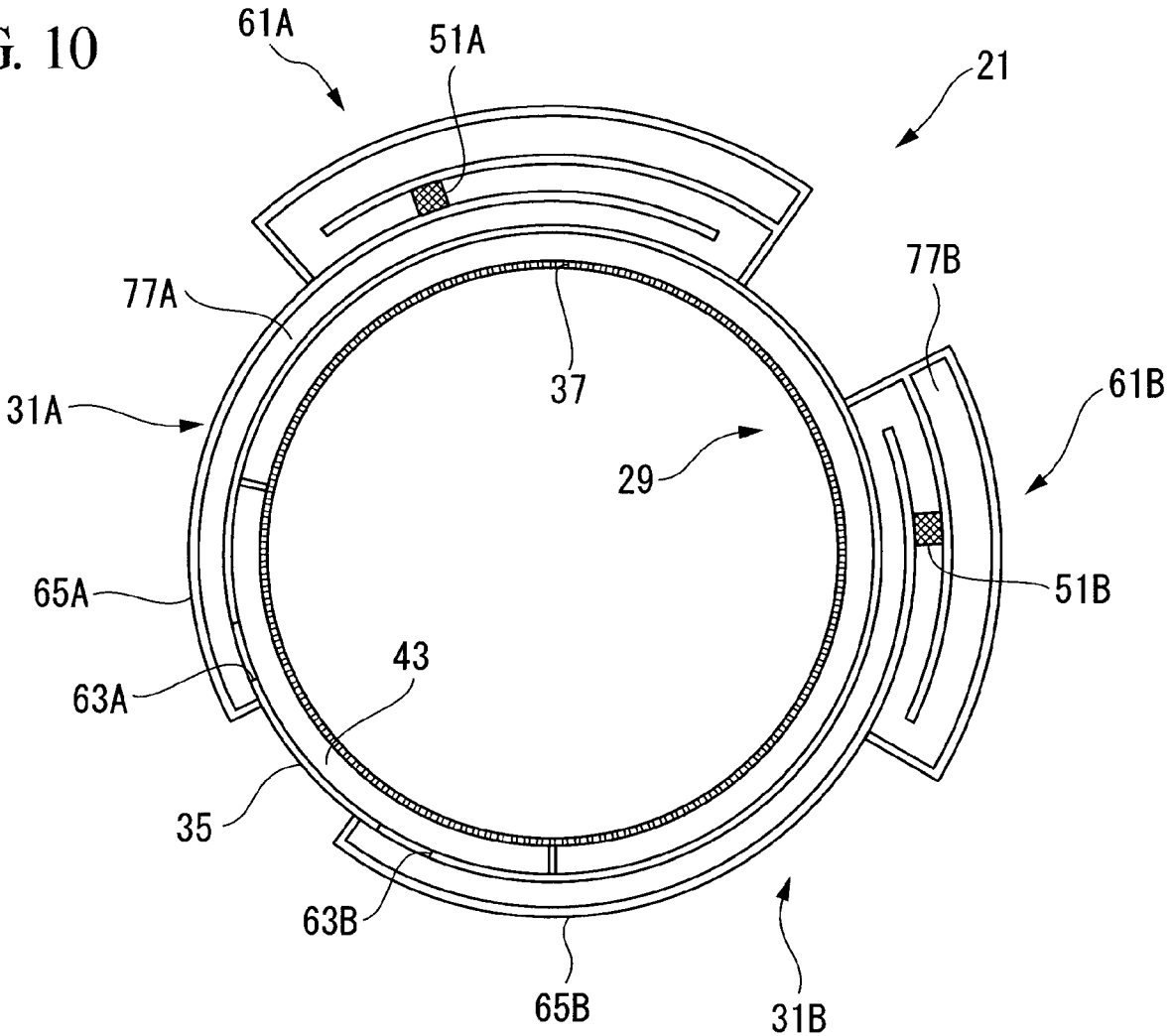
FIG. 10 is a partial sectional view showing a modification of the attenuating device according to the third embodiment of the present invention.

In such a case, as shown in FIG. 10, the two acoustic dampers 31A and 31B may be provided. The two acoustic dampers 31A and 31B are provided such that small-diameter portions 65A and 65B of damper covers 61A and 61B face each other. The small-diameter portions 65A and 65B are each joined to the outer surface of the liner cover 35. The liner cover 35 has openings 63A and 63B provided in portions covered by the damper covers 61A and 61B, respectively.

Because the oscillations can be attenuated by the plurality of acoustic dampers 31A and 31B, the oscillations can be more assuredly attenuated.

Accordingly, the oscillation attenuating performance of the acoustic dampers 31A and 31B can be more assuredly improved.

Furthermore, the volumes (lengths in the circumferential direction C, i.e., overall lengths of the resonance spaces) of the two acoustic dampers 77A and 77B may be differentiated, and the mounting positions of porous metal members 51A and 51B may be changed. By doing so, two acoustic dampers 31A and 31B having different attenuation frequency regions are created. Thus, it is possible to attenuate oscillations in several frequency regions in a relatively low frequency region or oscillations in a wide frequency region.

Note that the present invention is not limited to the above-described embodiments, but may be appropriately modified within a scope not departing from the spirit thereof.

For example, although the acoustic damper 31 and the acoustic liner 29 are integrally formed in the above-described embodiments, they may be independent and both mounted on the combustion cylinder 19. This can further reduce the amount of protrusion of the acoustic damper 31 toward the outer circumference.

In such a case, the acoustic-damper resonance spaces 49, 57, and 77 each directly communicate with the combustion area 23.

REFERENCE SIGNS LIST

1: gas turbine
3: compressor
7: turbine
19: combustion cylinder
23: combustion area
29: acoustic liner
31, 31A, 31B: acoustic damper
33: plate
35: cover
37: through-hole
43: first acoustic-damper resonance space
44: acoustic-liner resonance space
45, 53, 61: damper cover
49, 57, 77: second acoustic-damper resonance space
51, 51A, 51B: porous metal member (fluid resisting member)
53, 55: groove portion
L: axial direction

The invention claimed is:

1. A combustor comprising a cylindrical body that defines a combustion area therein; and an acoustic damper that includes an acoustic portion having an acoustic-damper resonance space communicating with the combustion area, wherein the acoustic portion is provided along the cylindrical body so as to extend in a direction intersecting an axial direction, and so as to be disposed widely in the circumferential direction, of the cylindrical body.

2. A combustor according to claim 1, further comprising an acoustic liner formed by a porous plate that constitutes the cylindrical body and has a plurality of through-holes penetrating in a thickness direction and a cover member that is provided around and at a certain distance from the porous plate so as to cover the porous plate, the acoustic liner having an acoustic-liner resonance space.

3. The combustor according to claim 2, wherein at least part of the acoustic portion is provided on the outer circumferential side of the cover member.

4. The combustor according to claim 1, wherein the acoustic-damper resonance space is formed so as to make at least one turn.

5. The combustor according to claim 1, wherein at least one fluid resisting member is provided in the acoustic-damper resonance space.

6. The combustor according to claim 1, wherein a plurality of the acoustic dampers are provided.

7. A gas turbine comprising an air compressor, the combustor according to claim 1, and a turbine.

* * * * *